US005924451A

United States Patent [19]

Kuo

[11] Patent Number: 5,924,451

[45] Date of Patent: Jul. 20, 1999

[54] STRUCTURE FOR FAUCET

[76] Inventor: Lian-Jie Kuo, P. O. Box 96-405, Taipei 106, Taiwan

[21] Appl. No.: 09/143,612

[22] Filed: Aug. 28, 1998

[51] Int. Cl.[6] ..... E03C 1/04

[52] U.S. Cl. ..... 137/801; 137/606; 4/676; 4/678

[58] Field of Search ..... 4/676, 678; 137/606, 137/801

[56] References Cited

U.S. PATENT DOCUMENTS 5,165,121 11/1992 McTargett et al. ..... 137/901 X
5,669,417 9/1997 Kuo .

FOREIGN PATENT DOCUMENTS 2104625 3/1983 United Kingdom ..... 137/801

*Primary Examiner*—Gerald A. Michalsky
*Attorney, Agent, or Firm*—Dougherty & Troxell

[57] ABSTRACT

An improved structure for faucet which the conventional faucet body has a casing portion made of brass punched into form, including an upper cover body and a lower cover body to be assembled together by using a connection edge and a plurality of positioning flanges. The water-output end thereof is fastened together by using a aerating seat and a fastening ring; the end of two cover bodys nearing the pull rod position is fastened together by means of a fixed bar and a pull-rod seat so as to have the casing portion and the water-guide assembly connected together as one piece. The inner space of the casing portion is mounted with the water-guide assembly to supply water.

12 Claims, 11 Drawing Sheets

STRUCTURE FOR FAUCET

BACKGROUND OF THE INVENTION

1. Field of the Invention

This invention relates to a faucet, and particularly to a faucet which can be assembled easily in terms of structure.

2. Description of the Prior Art

The conventional faucet is usually made of copper to be welded into a faucet pipe; of which the outer end is mounted with a faucet body in a suitable form; the outer edge of the faucet pipe is covered with an alloy of lead and zinc. i.e., the pipe containing no lead in the water passages.

Another conventional faucet is made of brass cast into a suitable decorative form; the water-intake end thereof is directly connected with, by means of threads, a water valve; the water can flow through the passage in the decorative portion and out of the aerator on the water output end. Since the brass contains heavy lead, which will be diluted into the drinking water after a long period of time, the body of people would contain more heavy lead after drinking it for a given period of time; therefore, people's health would be affected adversely. In order to prevent the aforesaid effect, the government of Texas State in U.S. published an order that the drinking water in faucet must not be in contact with a part, which is made of brass.

According to U.S. Pat. No. 5,669,417, of which the applicant is the same as that of the present invention, it has disclosed that a water-guide device in a tap, which includes an outlet connector with a circular plate, being mounted on the water outlet of a tap; the circular plate of the outlet connector is mounted on a positioning seat by means of a aerator; the other end of the outlet connector is formed into a cylindrical part to be connected together with a guide pipe; the guide pipe extends through a passage of the body portion of the tap, and to the outer end of a concave seat of the water inlet; the guide pipe is connected with a snap connector having a partitioning ring, and then is connected with a water valve seat. The guide assembly can provide an isolation structure between the water valve seat and the aerator so as to prevent water stream containing heavy lead from contact with the tap, i.e., to avoid lead being dissolved into water to jeopardize.

SUMMARY OF THE INVENTION

The prime object of the present invention is to provide a faucet structure, in which the conventional faucet body has a casing portion made of brass punched into form, including an upper cover body and a lower cover body to be assembled together by using a connection edge and a plurality of positioning flanges. The water-output end thereof is fastened together by using a aerating seat and a fastening ring; the end of two cover bodys nearing the pull rod position is fastened together by means of a fixed bar and a pull-rod seat so as to have the casing portion and the water-guide assembly connected together as one piece. The inner space of the casing portion is mounted with the water-guide assembly to supply water.

Another object of the present invention is to provide a faucet structure, in which the bottom surface of the lower cover body to be in contact with a fixed base is mounted with a threaded cylinder for fastening a threaded rod on the water-intake connector. The water-intake connector extends through a cylindrical hole of the fixed base, being fastened on the fixed base with a nut, and then through a pipe connector and water pipe to enable waters to flow out of the aerator.

Still another object of the present invention is to provide faucet structure, in which the water-output end of the casing portion is mounted with a aerating assembly; the aerating seat of the aerating assembly is connected with one end of the water-intake pipe assembly, while other end thereof is connected with the threaded rod of the water-intake connector. The ring-shaped groove of the aerating seat is engaged with the positioning ring in the water-output end of the lower cover body so as to connect together; the other end of the water-intake pipe assembly is connected with the water-intake connector by means of a nut so as to have the aerating assembly and the water-intake pipe assembly connected together.

A further object of the present invention is to provide a faucet structure, in which the aerating assembly on the water-output end of the casing portion is connected with the water pipe by means of threads. The outer surface of the aerating seat has a ring-shaped groove to receive the positioning ring of the lower cover body; finally, a fastening ring is mounted, by means of threads, with the aerating seat so as to have the upper and lower cover bodys clamped together.

A still further object of the present invention is to provide a faucet structure, in which the connecting edge of the lower cover body has a plurality of positioning flanges so as to facilitate the upper and lower cover bodys connected together along the connection edge between them; the positioning flanges are used to strengthen the connection between the two cover bodys.

Yet another object of the present invention is to provide a faucet structure, in which a round shoulder portion is furnished between the lower cover body and the base portion on the fixed base, nearing the water-intake end of the faucet body; the round shoulder portion has a through hole for receiving a fixed bar with a cylindrical hole; the other end of the fixed bar extends through the top of the upper cover body to be connected with a pull-rod seat with a cylindrical hole so as to have the upper and lower cover bodys connected together; the cylindrical hole of the pull-rod seat is mounted with the pull rod, which extends through the fixed base.

Yet still another object of the present invention is to provide a faucet structure, in which the upper and lower cover bodys are punched into a form by using a copper sheet, and connected together; the water pipe between the upper cover body and the lower cover body can be mounted in place easily and simply without touching any assembly which contains heavy lead.

DETAILED DESCRIPTION OF THE PREFERRED EMBODIMENT

Figure 1:
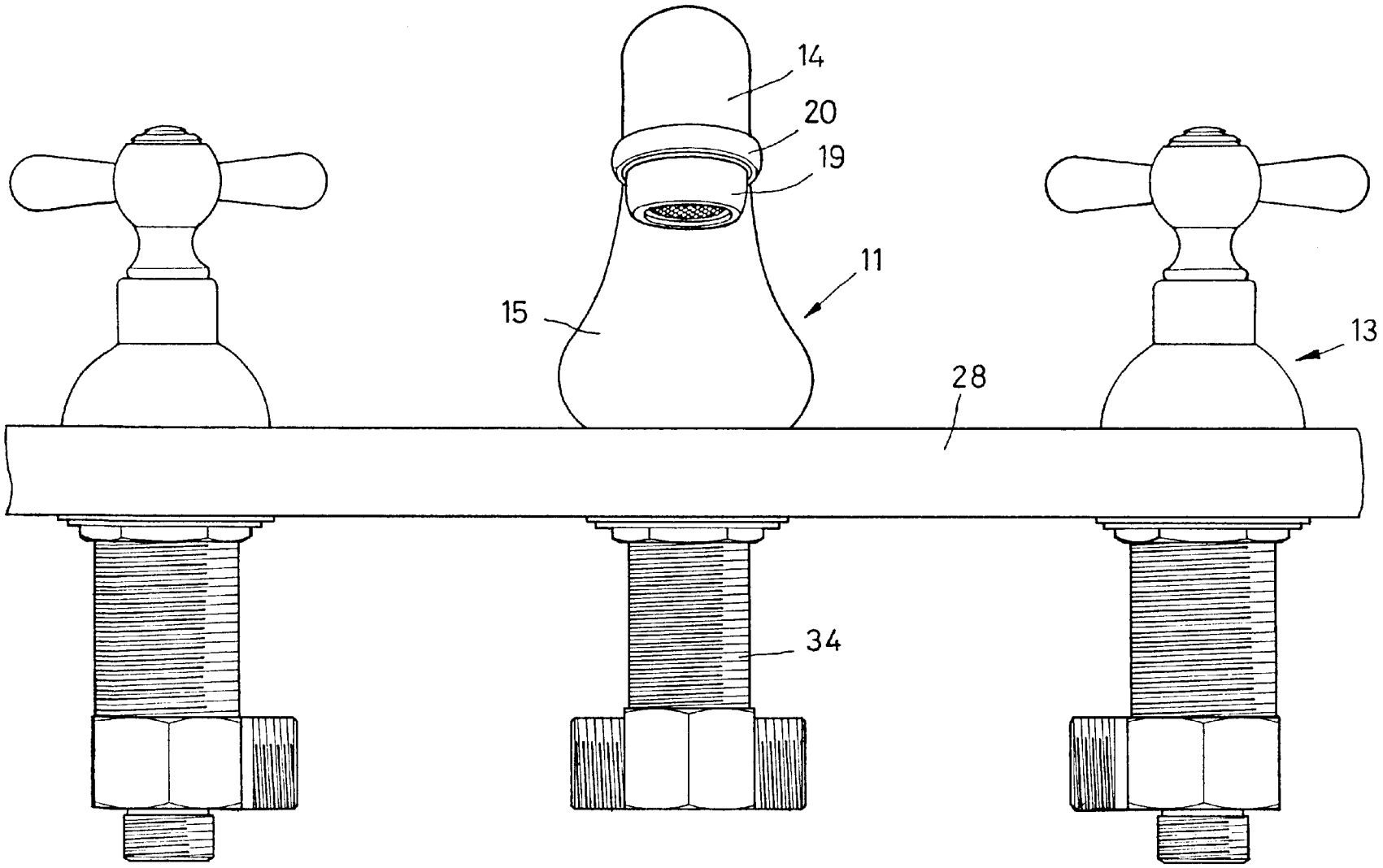
FIG. 1 is a plan view of the present invention, showing the relation between the faucet body and the water valve.
Figure 2:
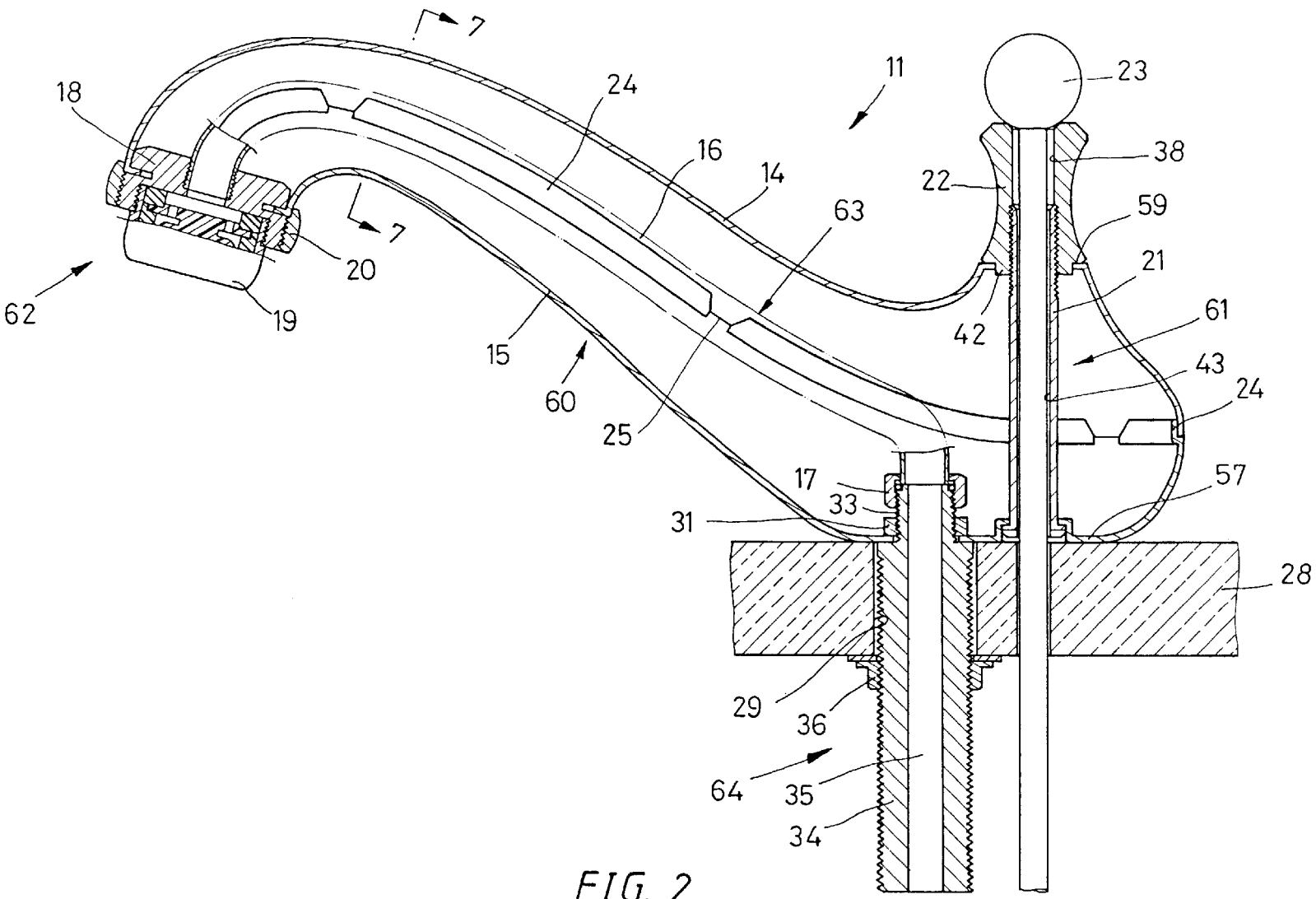
FIG. 2 is a sectional view of the present invention, showing the water-guide structure of the faucet body.

Referring to FIGS. 1 and 2, the faucet body 11 and two water valves 13 are fixedly mounted on one fixed base 28; the two water valves 13 are used for supplying cold and hole water respectively; the water can flow through a water intake pipe assembly 63 inside the faucet body 11 to the aerator 19.

Referring to FIGS. 1 to 7, the faucet includes a casing portion 60, a aerating assembly 62, the water intake pipe assembly 63 and a fastening assembly 64. The casing portion 60 further includes an upper cover body 14 and a lower cover body 15, which are punched into form by using brass; the upper and lower cover bodys are assembled together along a connection edge 25 between them, and by adding other parts, so as to form into a faucet.

The lower cover body 15 of the casing portion 60 is furnished with a base portion 57 to be in contact with a fixed base 28. The surface of the base portion 57 is furnished with a round shoulder portion 44 and a through hole 58; the round shoulder portion 44 is used for receiving a fixed bar 21 of a pull rod assembly 61. By means of the pull rod assembly 61, the upper and lower cover bodys 14 and 15 can be connected together at one end thereof. The inner side of the through hole 58 in the base portion 57 is welded with a threaded cylinder 31 having a suitable length so as to fasten a threaded hole 32 of the water-intake connector 34. The water-intake connector 34 is connected with the water valve 13 by means of pipe so as to control the flow of water. The lower cover body 15 of the casing member 60 extends to the water-output end. The inner edge of the lower cover body 15 is furnished with a positioning ring 46 for mounting a aerating assembly 62 by means of a aerating seat 18. In order to have a better connection and guide, and to prevent the casing portion 60 from deformation, the connection edges 25 of the lower cover body 15 are furnished with a plurality of positioning flanges 24 to facilitate the connection between the upper and lower cover bodys 14 and 15.

The upper cover body 14 of the casing portion 60 is formed into a shape of the upper part of the faucet. The position for mounting the pull rod assembly 61 has a flat part 59 on the upper cover body; the center of the flat part 59 has a round hole 41 for receiving a pull-rod seat 22 of the pull rod assembly 61. The upper cover body 14 of the casing portion 60 extends to the water-output end. The inner edge of the water-output end in the upper cover body 14 is furnished with a positioning ring 65 for mounting the aerating assembly 62 in place by means of a aerating seat 18.

Before assembling the casing portion 60, the fastening assembly 64 and the lower cover body 15 of the casing portion 60 must be assembled together, and the aerating assembly 62 and the water-intake pipe assembly 63 must be assembled and mounted inside the lower cover body 15; then, the upper cover body 14 and the lower cover body 15 are assembled together.

The base portion 57 of the lower cover body 15 has a through hole 58 welded with a threaded cylinder 31 therein; the threaded cylinder 31 has a threaded hole 32 for fastening a threaded rod 33 on the upper end of the water-intake connector 34; the threaded rod 33 has a smaller diameter portion extended upwards at a suitable length. The threaded rod 33 is to be connected with a nut 17 at one end of the water-intake pipe assembly 63; the threaded rod 33 at one end of the water-intake connector 34 has a smaller diameter to be mounted in the threaded cylinder 31 in the lower cover body 15, while the other end of the water-intake pipe 34 has a threaded rod with a larger diameter to be connected with a pipe connector. The water-intake connector 34 has a passage hole 35 in the center thereof.

Figure 8:
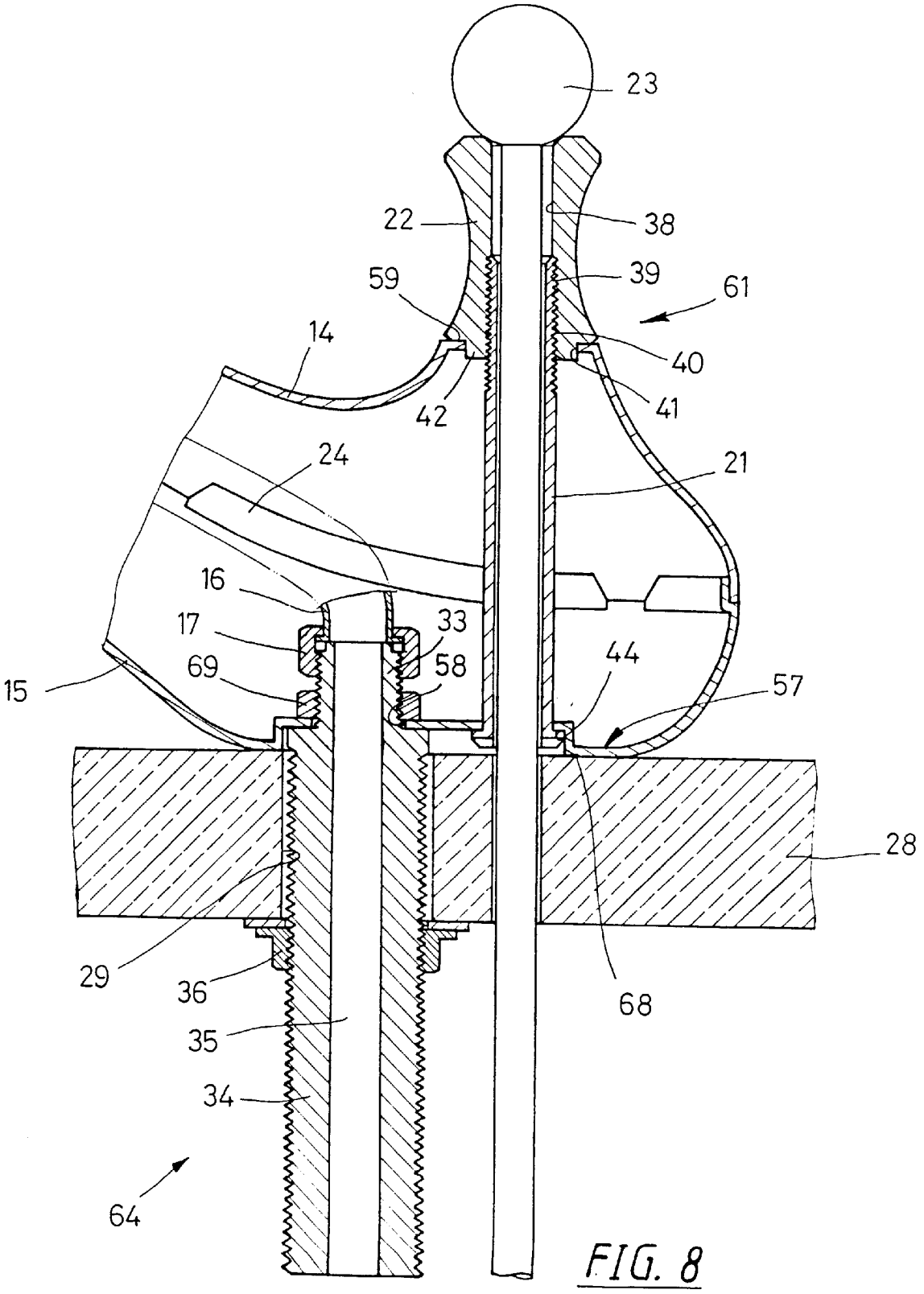
FIG. 8 is a sectional view of the fastening assembly of embodiment-2 according to the present invention.

Referring to FIG. 8, the through hole 58 in the base portion 57 of the lower cover body 15 has a flat portion for receiving the threaded rod 33 on the water-intake connector 34; the threaded rod 33 is fastened in place with nut 69 so as to have the water-intake connector 34 and the base portion 57 of the lower cover body 15 assembled together.

A bottom surface 68 of the base portion 57 contacted with the fixed base 28 has a recess portion, in which a round shoulder portion 44 and the through hole 58 are on the same flat surface for mounting the pull rod assembly 61 and the water-intake connector 34 respectively.

Referring to FIGS. 1, 2, 5 and 6, the aerating assembly 62 including a aerating seat 18, a aerator 19 and a fastening ring 20; the outer surface of the aerating seat 18 has a ring-shaped groove 47, a cylindrical portion 48, and an outer thread portion 49. The center of the aerating seat 18 has a threaded hole 51 for mounting the thread end of a water pipe 16. Under the threaded hole 51, there is a through hole 53 furnished with inner threads 50. The upper end of the aerator 19 is furnished with outer threads 56 to facilitate connection between the aerator 19 and the inner threads 50 of the aerating seat 18. The outer surface of the fastening ring 20 is a convex surface, while the inner surface thereof has inner threads 54 and an upper surface 55 having a larger diameter; the inner threads 54 is to engage with the outer threads 49 of the aerating seat 18. One end of the aerating seat 18 is connected first with the threaded end of the water pipe 16, while the other end having inner threads 50 is connected with the aerator 19; then, the ring-shaped groove 47 of the aerating seat 18 is fitted in the positioning ring 46 of the lower cover body 15 so as to hold the seat 18 in place. The other side of the ring-shaped groove 47 is mounted on the positioning ring 65 of the upper cover body 14. The outer thread portion 49 of the aerating seat 18 extends out of the positioning ring 46 of the casing portion 60. After the outer thread portion 49 of the aerating seat 18 is engaged with the inner threads 54 of the fastening ring 20, the ends of the upper and lower cover bodys 14 and 15 will be held in the upper surface 55 above the inner threads 54 of the fastening ring 20. In addition to using the ring-shaped groove 47 of the aerating seat 18 to hold the upper and lower cover bodys 14 and 15 in place, the fastening ring 20 is also used to hold the upper and lower cover bodys 14 and 15 together as a water-output end without loosening unintentionally.

The water-intake pipe assembly 63 includes a nut 17 and a water pipe 16 which is made of copper, and one end thereof is furnished with outer threads 66, while the other end thereof is furnished with a ring-shaped flange 37 to connect with a nut 17 of the threaded rod 33, and the nut 17 is mounted from the threaded end of the water pipe 16 to move towards the end of the ring-shaped flange 37; the flange 37 is substantially fitted in the nut 17; an O-ring 30 is mounted under the ring-shaped flange 37 as a hermtical seal member.

The outer threads 66 of at one end of the water pipe 16 are engaged with the aerating seat 18 of the aerating assembly 62; first, the ring-shaped groove 47 of the aerating seat 18 is connected with the positioning ring 46 of the lower cover body 15, and then the nut 17 at one end of the water pipe 16 is mounted directly on the threaded rod 33 in the base portion 57 of the lower cover body 15 so as to have the water-intake pipe assembly 63 positioned to complete the connection of the water-guide assembly.

The connection among the water pipe 16 of the water-intake pipe assembly 63, the pull rod assembly 61 and the aerating seat 18 can be made by using a round rod at one end of the water pipe 16; the round rod is plugged in a round hole of the aerating seat 18, being welded in place.

One side of the aerating seat 18 of the aerating assembly 62 is detained in place after one end of the water-intake pipe assembly 63 connected with the threaded rod 33 of the water-intake connector 34. When the upper and lower cover bodys 14 and 15 are assembled together, the positioning ring 65 of the upper cover body 14 will be engaged in the ring-shaped groove 47 of the aerating seat 18, and the two cover bodys will also be connected along the connection edge 25; simultaneously, the positioning flanges 24 on the lower cover body 15 will be positioned along he inner edge of the upper cover body 14, i.e., the upper cover body 14 covering the lower cover body 15. After the connecting surface of the water-output end of the casing portion 60 is fastened with the fastening ring 20 of the aerating assembly 62 and the outer threads 49 of the aerating seat 18, the upper surface 55 above the inner threads 54 of the fastening ring 20 will be mounted around the outer surface of the water-output end of the casing portion 60.

After the water-output end of the casing portion 60 is fastened with the aerating assembly 62, the pull rod assembly 61 is used to hold the upper and lower cover bodys 14 and 15 in place; the pull rod assembly 61 includes a fixed bar 21 and a pull-rod seat 22; one end of the fixed bar 21 has a threaded rod 40, while the other end thereof is furnished with a T-shaped and slotted head to be fitted with a screwdriver; the center of the fixed bar 21 has a through cylindrical hole 43. The pull-rod seat 22 is so designed as to conform to the shape of the pull rod on the casing portion 61; the pull-rod seat has a cylindrical hole 38 with a threaded hole 39 on the lower end thereof, and has a short positioning rod 42 at the lower end thereof. The positioning rod 42 is used for guiding the pull-rod seat into a round hole 41 of the flat part 59 in the upper cover body 14 so as to have the outer surface of the positioning rod 42 mounted on the flat part 59 of the upper cover body 14.

To assemble the aerating assembly 62, plug the fixed bar 21 first into the through hole 67 of the round shoulder portion 44 in the base position 57 of the lower cover body 15; the threaded rod 40 of the fixed bar 21 is mounted out of the round hole 41 of the flat part 59 in the upper cover body 14. The threaded hole 39 of the pull-rod seat 22 is connected with the threaded rod 40 of the fixed bar 21; the positioning rod 42 on lower end of the pull-rod seat 22 is guided into the round hole 41 of the flat part 59 in the upper cover body 14. The T-shaped and slotted head of the fixed rod 21 is driven with a screwdriver so as to have the rod 21 and the pull-rod seat 22 connected together. The pull rod 23 extends through cylindrical hole 38 of the pull-rod seat 22 and the cylindrical hole 43 of the fixed bar 21. After the pull rod 23 is mounted on the fixed base 28, it will extend below the fixed base 28 to connect with the water-exhaust valve rod.

Figure 3:
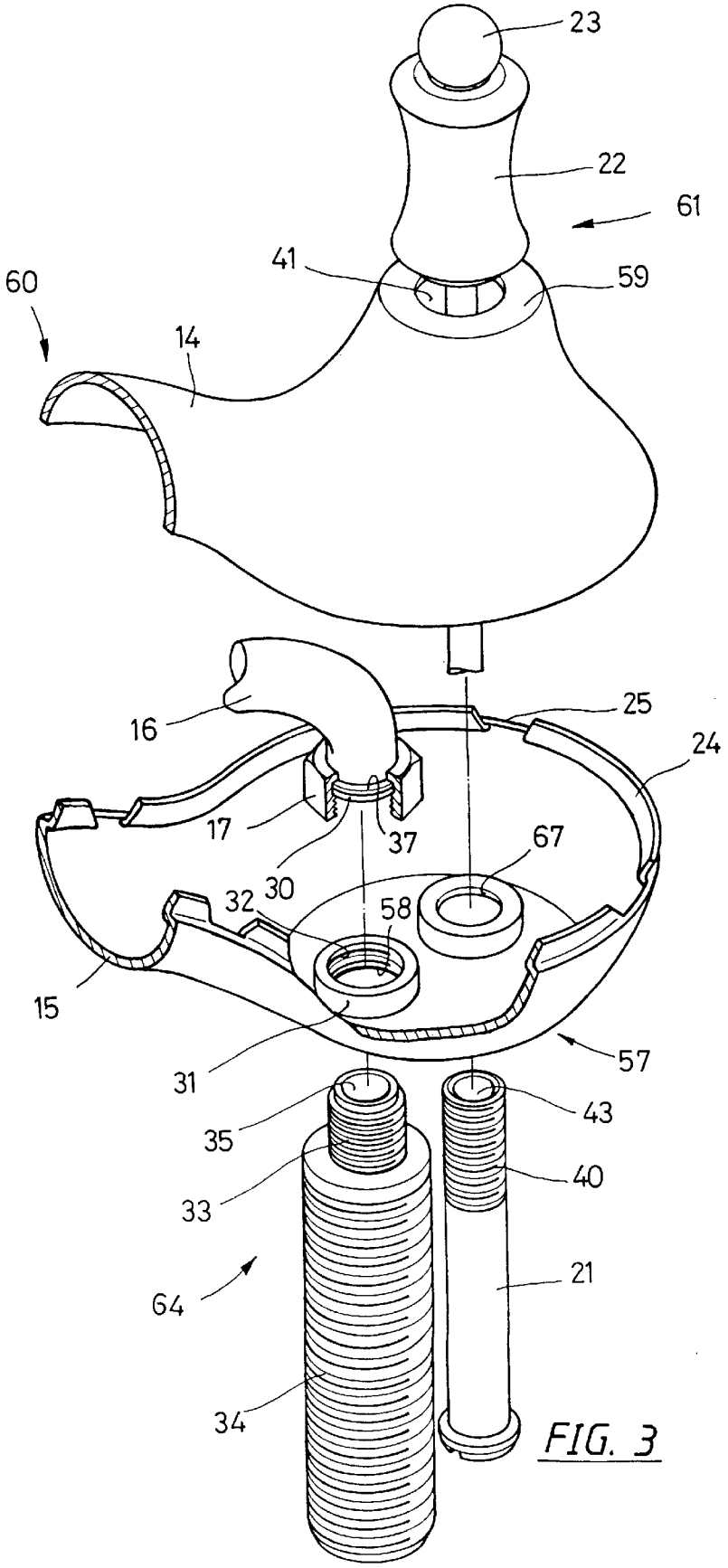
FIG. 3 is a disassembled view of the present invention, showing the structure of the lower cover body.
Figure 4:
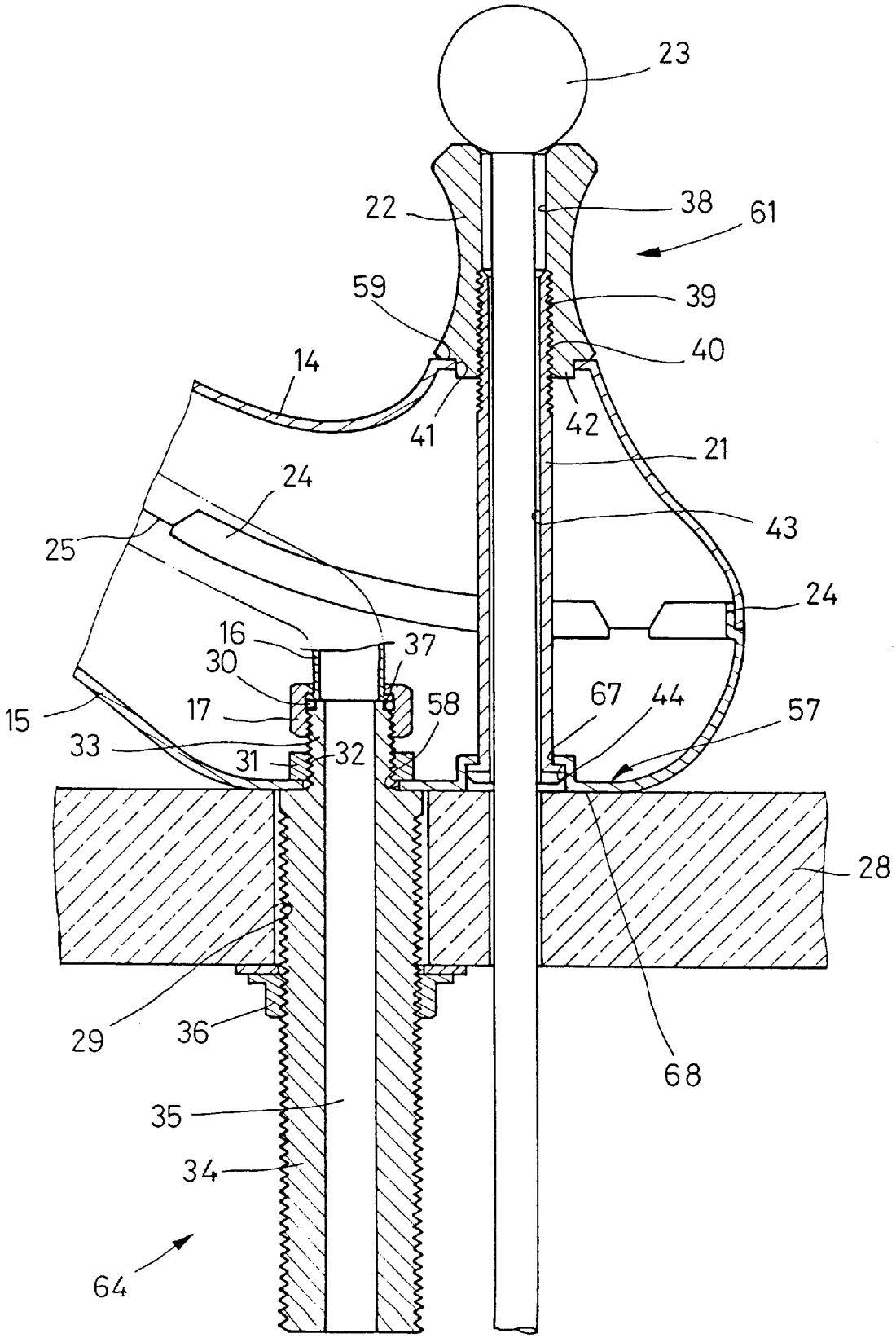
FIG. 4 is a sectional view of the present invention, showing the structure of the water-intake end of the faucet body.

Referring to FIGS. 2 to 4, a fastening assembling 64 is mounted on the base portion 57 of the lower cover body 15 of the casing portion 60, and the threaded rod 33 thereof extends into the lower cover body 15 so as to have the aerating assembly 62 and the casing portion 60 connected together. The aerating assembly 62 is mounted in place by means of the positioning ring 46 on the water-output end of the lower cover body 15. As soon as the nut 17 of the water-intake pipe assembly 63 and the threaded rod 33 of the fastening assembly 64 are connected together, the water-intake pipe assembly 63 will be fastened in place; the connection edge 25 of the lower cover body 15 and the positioning flanges 24 will enable the upper cover body 14 to connect and seal with the lower cover body together. The pull rod 23 is to be mounted in place by means of the fixed bar 21 of the pull rod assembly 61 extended through the through hole 67 in the base portion 57 of the lower cover body 15, and connected with the pull-rod seat 22; simultaneously, the aerating assembly 62 on the water-output end of the faucet is mounted to the aerating seat 18 by means of the fastening ring 20 so as to assembly the upper and lower cover bodys 14 and 15 and parts related together into one piece. After the water-intake connector 34 of the fastening assembly 64 is mounted through the cylindrical hole 29 of the fixed base 28, a lock nut 36 is used to fasten the faucet body 11 to the fixed base 28; the water-intake connector 34 is connected with the pipe connector under the water valve 13 by means of a pipe connector, and then water can be controlled to flow out through the water-intake connector 34 of he fastening assembly 64, the water pipe 16 of the water-intake pipe assembly 63, and the aerator 19 of the aerating assembly 62.

Figure 9:
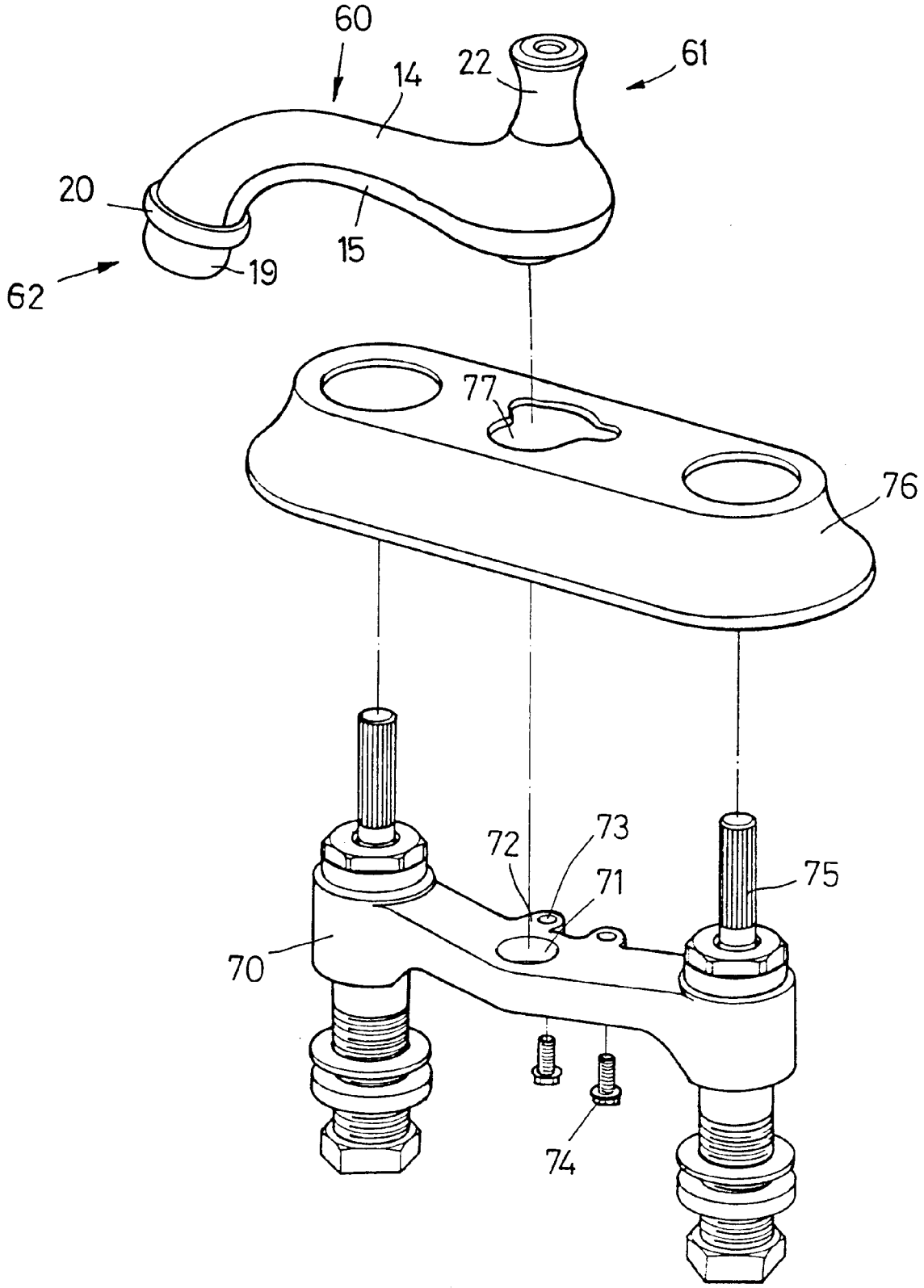
FIG. 9 is a disassembled view of the present invention, showing the structure of the H-shaped valve seat.
Figure 10:
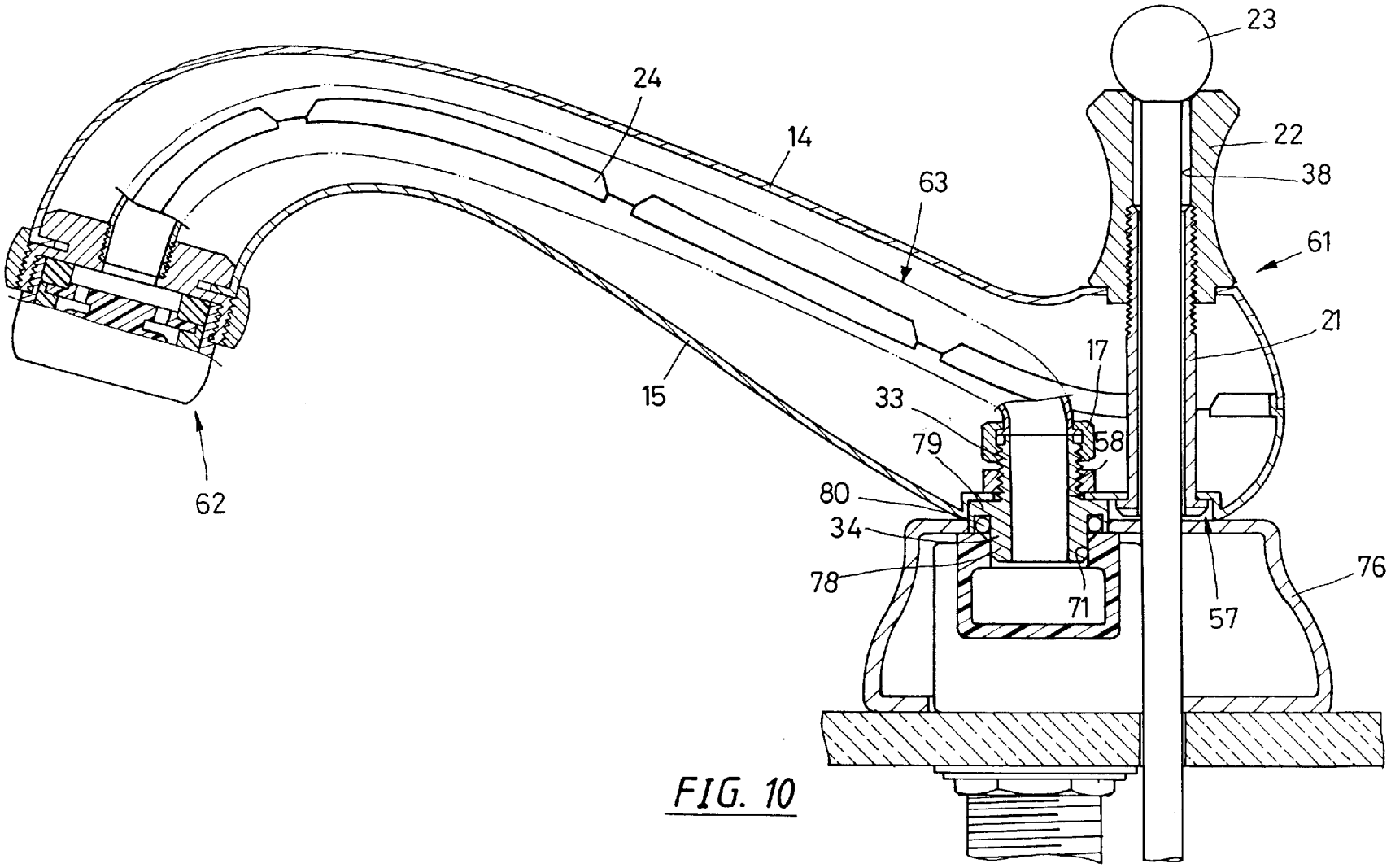
FIG. 10 is a sectional view of the present invention, showing the assembled structure between the faucet body and the H-shaped valve seat.
Figure 11:
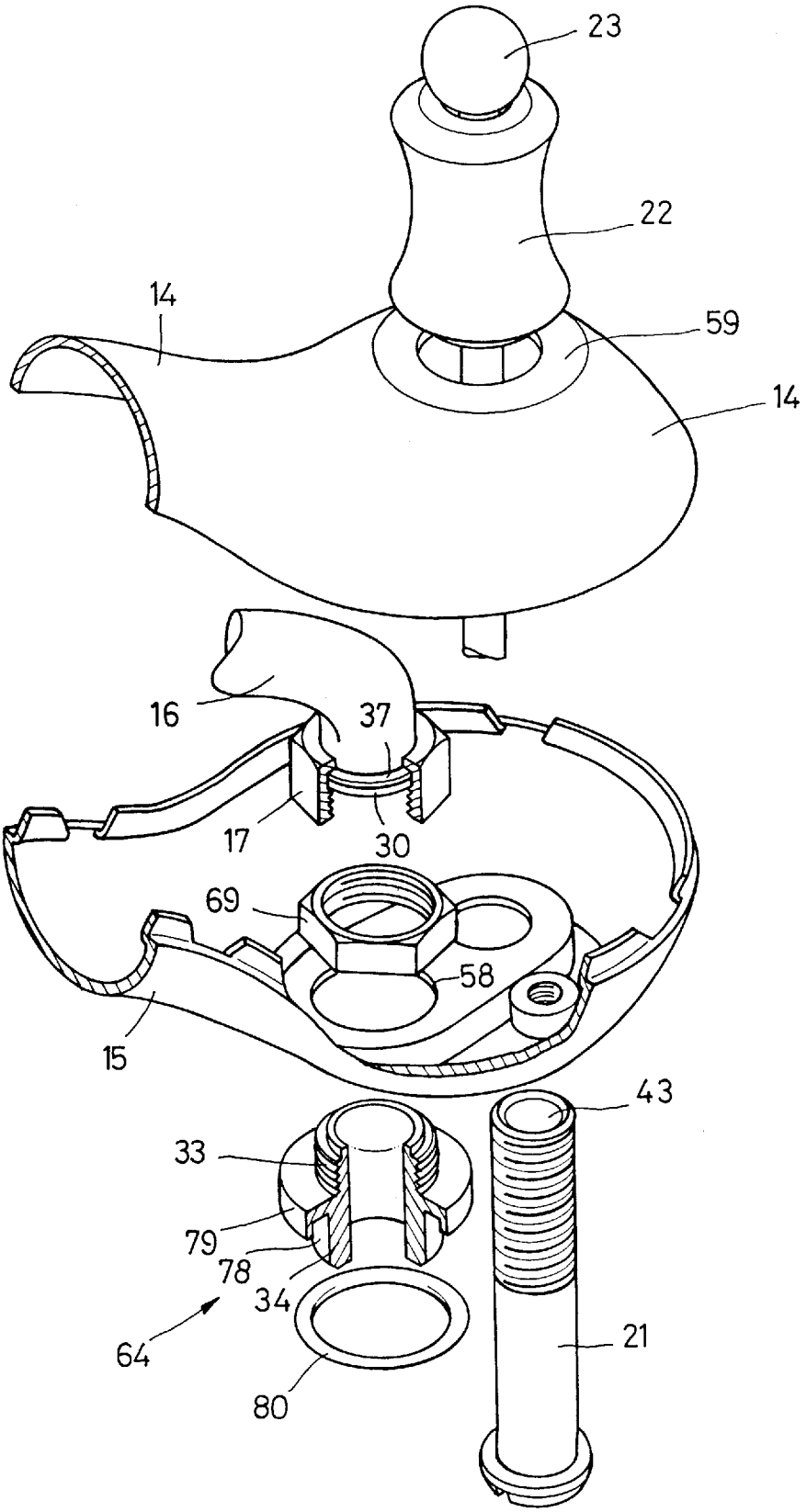
FIG. 11 is a sectional view of the present invention, showing the assembled structure between the lower cover body and the H-shaped valve seat.

Referring to FIGS. 9 to 11, the faucet body 11 is mounted in cylindrical hole 71 in a H-shaped valve seat 70 made of heatproof plastics. Both ends of the H-shaped valve seat 70 are furnished with water valves 75 respectively; a water pipe is furnished to connect the two water valves 75. The mid-portion of the H-shaped valve seat 70 has a cylindrical hole 71 and two fastening plates 72 of which each having a round hole 73 for receiving screw 74 so as to fasten the faucet body 11 on the fixed rack 76. When the faucet body 11 is mounted in the cylindrical hole 71 of the H-shaped valve seat 70, the structure of the water-intake connector 34 in the aforesaid embodiment will be changed, i.e., the threaded rod 33 on the upper end of water-intake connector 34 has the same diameter, but a cylindrical wall 79 under the threaded rod 33 has a larger diameter than that of the through hole 58; under the cylindrical wall 79, there is a cylindrical portion 78, of which the diameter is determined in accordance with the diameter of the cylindrical hole 71 in the H-shaped valve seat 70. The cylindrical portion 78 is mounted with an O-ring 80. The threaded rod 33 of the water-intake connector 34 extends through the through hole 58 and into the base portion 57 of the lower cover body 15, and then is mounted with a nut 69. The upper end of the threaded rod 33 is the same as that of the aforesaid embodiment, i.e., the nut 17 on one end of the water-intake pipe assembly 63 is connected with the water-intake connector 34 so as to guide water to flow.

When assembling the faucet body 11, insert the water-intake connector 34 through the through hole 77 of the fixed rack 76, and have the bottom surface of the lower cover body 15 closely contacted with the top surface of the fixed rack 76; the cylindrical portion 78 of the water-intake connector 34 is inserted in the fastening plate 72 of the water-intake pipe of the H-shaped valve seat 70. Before using screws 74 to fasten the assembly, the O-ring 80 must be mounted under the cylindrical wall 79 to provide a hermtical seal so as to guide water to flow directly through the fastening plate 72, the water-intake connector 34, the water-intake pipe assembly 63 and the aerating assembly 62.

The difference between the two embodiments according to the present invention includes the shape of the faucet body 11, the water-intake connector 34 connected with the base portion 57 of the lower cover body 15, and the valves and the valve seat; the rest parts, such as the pull rod assembly 61, the aerating assembly 62 and them water-intake pipe assembly 63, etc. are the same as the conventional parts thereof so as to provide quick and easy installation of the faucet.

Figure 5:
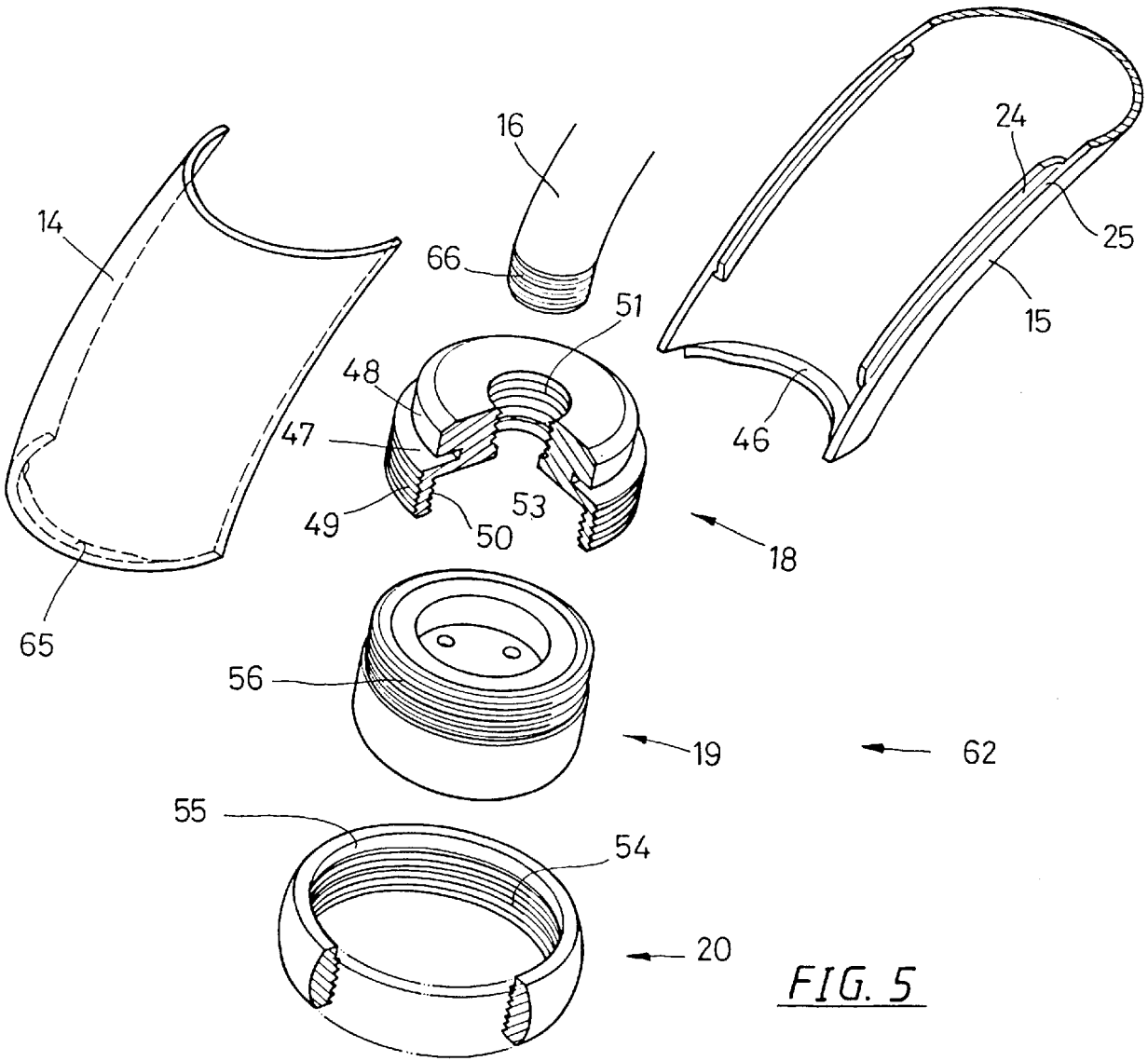
FIG. 5 is a disassembled view of the present invention, showing the structure of the water-output assembly.
Figure 7:
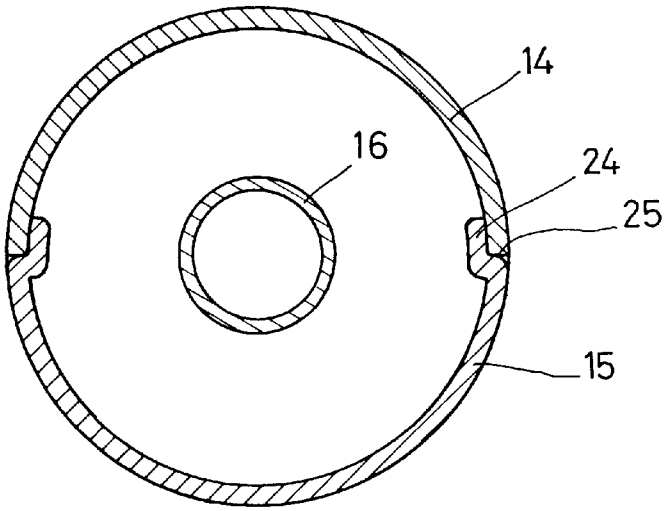
FIG. 7 is a sectional view of the present invention taken along line 7-2 in FIG. 2.
Figure 6:
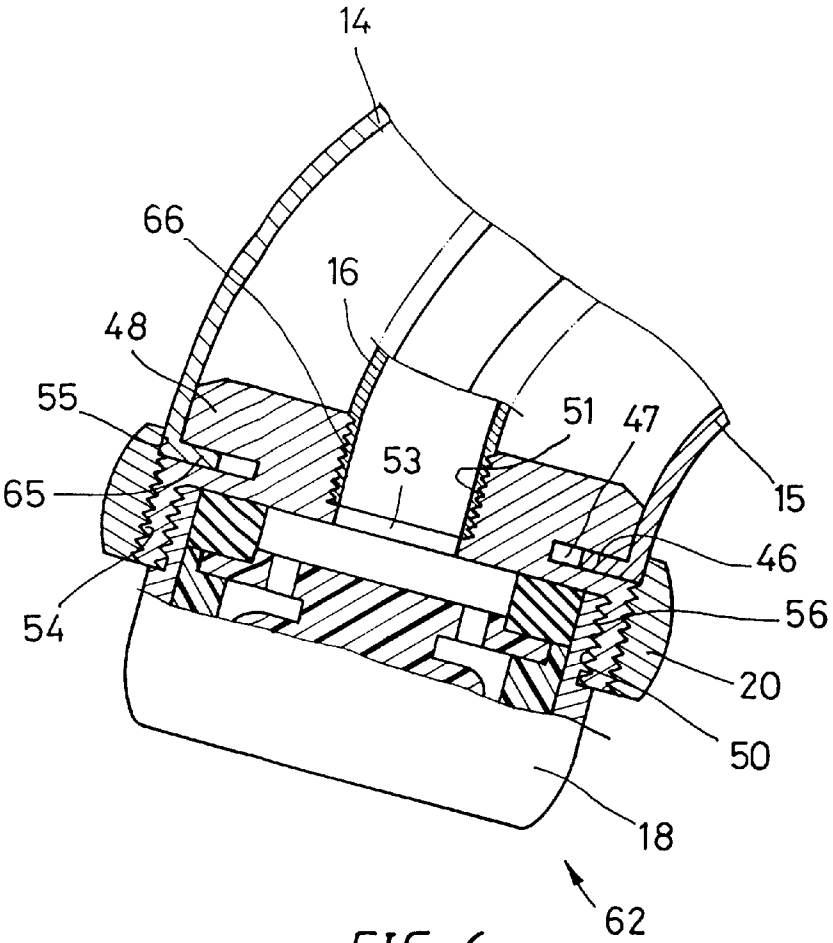
FIG. 6 is a sectional view of the water-output assembly according to the present invention.
Figure 12:
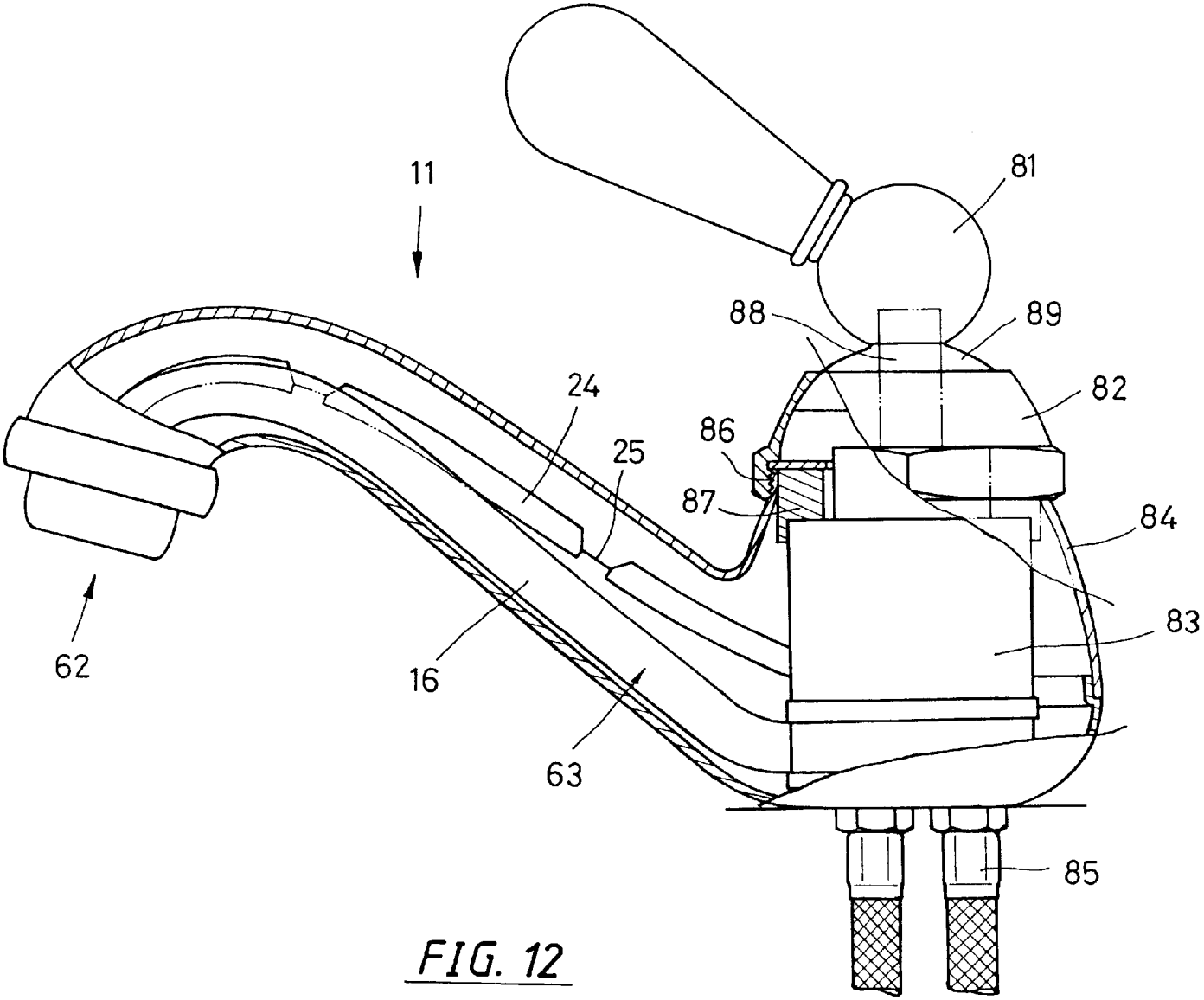
FIG. 12 is a sectional view of the present invention, showing a cold-hot water blending valve mounted in the casing portion.

Referring to FIGS. 12, 5 and 6, the faucet body 11 is mounted with a single control rod 81, and the faucet comprises a casing portion 60, a single control rod 81, an upper cap 82, a cold-hot water blending valve 83, an aerating assembly 62, a water-intake pipe assembly 63 and a fastening assembly; the cold-hot water blending valve 83 is mounted at the water-intake end between the upper cover body 14 and the lower cover body 15; the cold-hot water blending valve 83 and the water pipe 16 of the water-intake pipe assembly 63 are combined together as one piece. The outer end of the water pipe 16 and the aerator seat 18 of the aerating assembly 62 are assembled together. The lower cover body 15 of the casing portion 60 is designed in accordance with the shape of the faucet controlled with the single control rod 81, i.e., being punched in shape by using a sheet metal; the water-intake end thereof is furnished with a flat seat for mounting the cold-hot water blending valve 83, which is retained in position by means of the ring-shaped groove 47 in the aerator seat 18 of the aerating assembly 62, and the positioning ring 46 on the water-output end of the lower cover body 15. The bottom of the cold-hot water blending valve 83 is in contact with the base portion 57 of the lower cover body 15 before being fastened in place with screws so as to prevent the cold-hot water blending valve 83 from shiftng unintentionally; then, the water-intake pipe assembly 63 and the cold-hot water blending valve 83 are fixedly mounted in a space above the lower cover body 15. The bottom of the cold-hot water blending valve 83 is furnished with a screw hole to facilitate connection of the cold-hot water intake pipe 85. The contact edges between the lower and upper cover bodys 15 and 14 are furnished with connection edges 25 for hermetic connection; the inner side of the connection edge 25 of the lower cover body 15 is furnished with a plurality of positioning flanges 24, of which the outer edges are to be engaged with the inner surface of the upper cover body 14.

The upper cover body 14 of the casing portion 60 is formed in accordance with the faucet mounted with the single control rod 81, and is made of a sheet metal punched into shape. The water-output end of the upper cover body 14 is furnished with a positioning ring 65 to be connected with the ring-shaped groove 47 of the aerator seat 18; the inner space thereof is furnished with a cylinder body 84 for receiving the cold-hot water blending valve 83. The upper and outer end of the cylinder body 84 has threads 86 for mounting a threaded cap 82.

The lower cover body 15 of the casing portion 60 is to be connected together first with the cold-hot water blending valve 83 by means of threads; the cylinder body 84 of the upper cover body 14 is mounted on the cold-hot water blending valve 83 first; the positioning ring 65 thereof is connected with the ring-shaped groove 47 of the aerator seat 18, and then assemble the upper and lower cover bodys 14 and 15 together by means of the connection edges 25 thereof; a positioning member 87 is mounted between the upper portion of the cold-hot water blending valve 83 and the inner edge of the cylinder body 84, and then a washer is mounted thereon before mounting the threaded cap 82 on the cylinder body 84 so as to fasten a ball seat 89 under the single control rod 81 and the swinging shaft 88 of the cold-hot water blending valve 83 together; finally, turn the threaded cap 82 for engaging with the threads 86 on the end of the cylinder body 84, and then the ball seat 89 of the single control rod 81 will be fastened in place; simultaneously, the cold-hot water blending valve 83 will also be fastened in place. The ends of the upper and lower cover bodys 14 and 15 are fastened in place by means of the outer threads portion 49 of the aerator of aerating assembly 62 and the fastening ring 20.

This embodiment has a structure including casing portion 60, the water-intake pipe assembly 63 and aerating assembly 62 as used in the aforesaid embodiment so as to facilitate mounting he cold-hot water blending valve 83, which can be controlled with the single control rod 81. When turn the single control rod 81 right-wards or left-wards, the blending ratio of the cold and hot water will be changed properly; when turn the single control rod 81 up or down, the water flow will be changed; water will flow through the water pipe 16 of the water-intake pipe assembly 63 and out of the aerator 19 of the aerating assembly 62.

According to the aforesaid embodiments described, the features of the method have been disclosed completely, and they are never shown and anticipated by the person skilled in the art; therefore, the present invention is deemed novel and practical.

What is claimed is:

1. An improved structure for faucet comprising:

a casing portion which includes an upper cover body and a lower cover body; said lower cover body having a base portion and a bottom surface to be in contact with a fixed base; said bottom surface having a through hole for receiving a threaded rod on a water-intake connector; a through hole for mounting a fixed bar of a pull rod assembly; said upper cover body mounted and connected hermetically on a connection edge of said lower cover body;

a fastening assembly, in which said threaded rod on said water-intake connector extending through said through hole in said base portion of said lower cover body, and said threaded rod being fastened in place with a nut;

a aerating assembly including:

a aerating seat having a ring-shaped groove on outer surface thereof, and said ring-shaped groove furnished with threads under the same; said ring-shaped groove furnished with threads under the same; said ring-shaped groove used for embedding positioning rings on water-output end formed with said upper and lower cover bodys so as to cover an inner cylindrical portion on upper part of said aerating seat; center of said aerating seat furnished with a threaded hole for connecting a water pipe, and a through hole furnished under said threaded hole and being in communication with inner thread hole;

an aerator furnished with outer threads on upper part thereof so as to connect with said inner threads in center of said aerating seat;

a fastening ring having a convex surface furnished above said inner threads, and said inner threads engaged and connected with outer thread portion of said aerating seat; said upper surface used for binding water-output ends of said upper and lower cover bodys;

a water-intake pipe assembly including a water pipe made of copper, and one end thereof furnished with a ring-shaped flange being mounted with nut, while other end of said water pipe furnished with outer threads to be connected with a threaded hole in said aerating seat; said nut on other end thereof being mounted on said threaded rod of said water-intake connector;

a pull rod assembly including:

a fixed bar, of which one end having a T-shaped and slotted head; having a cylindrical hole in center thereof, and other end thereof furnished with a threaded rod to extend through a round shoulder portion of said base portion of said lower cover body and through a round hole in a flat part of said upper cover body;

a pull-rod seat having an outer shape to conform to said casing portion and said pull rod, and having a through cylindrical hole in center thereof; bottom thereof being mounted on flat part of said upper cover body; lower part of said cylindrical hole furnished with a threaded hole to be connected with said threaded rod of said fixed bar so as to fasten said upper and lower cover bodys together; said cylindrical hole for receiving a pull rod to extend under a fixed base.

2. An improved structure for faucet as claimed in claim 1, wherein said upper and lower cover bodies of said casing portion are made of a sheet material punched into shape; a connection edge furnished between said upper and lower cover bodies to provide hermetical connection; said connection edge on said lower cover body furnished with a plurality of positioning flanges which being engaged with inner surface of said upper cover body to provide said cover bodies with a proper position.

3. An improved structure for faucet as claimed in claim 1, wherein said pull-rod seat and a flat part having a round hole are furnished above said upper cover body of said casing portion, and said round hole receiving a position rod under said pull-rod seat, and said positioning rod seated on said flat part of said upper cover body.

4. An improved structure for faucet as claimed in claim 1, wherein said base portion of said lower cover body has a through hole for receiving a threaded rod on said water-intake connector, and said threaded rod being fastened in position with a nut.

5. An improved structure for faucet as claimed in claim 1, wherein said base portion of said lower cover body has a through hole for receiving a threaded rod on said water-intake connector; a threaded cylinder welded on inner surface of said through hole so as to fasten said threaded rod in position.

6. An improved structure for faucet as claimed in claim 1, wherein said base portion of said lower cover body has a through hole for receiving said threaded rod of said water-intake connector; said threaded rod being fastened in position with a nut.

7. An improved structure for faucet as claimed in claim 1, wherein said base portion of said lower cover body has a through hole for receiving said threaded rod; a threaded cylinder with a threaded hole being fastened on inner surface of said through hole so as to fasten said threaded rod in position.

8. An improved structure for faucet as claimed in claim 1, wherein said water pipe of said water-intake pipe assembly is connected with said aerating seat; one end of said water pipe furnished with threads to be engaged with threads on said aerating seat so as to have the same connected together.

9. An improved structure for faucet as claimed in claim 1, wherein said water pipe of said water-intake pipe assembly is connected with said pull rod assembly and said aerating seat by using a round rod on one end of said water pipe to be welded to a round hole in center of said aerating seat.

10. An improved structure for faucet as claimed in claim 1, wherein lower end of said pull-rod seat of said pull-rod assembly has a short positioning rod to be plugged in a round hole of a flat part of said upper cover body so as to have an upper surface of said positioning rod rested on said flat part of said upper cover body.

11. An improved structure for faucet comprising a casing portion, a pull rod assembly, a aerating assembly, a water-intake pipe assembly; and a fastening assembly; said fastening assembly mounted on water-intake end of said casing portion; said aerating assembly mounted on water-output end of said casing portion, and said water-intake pipe assembly mounted between said fastening assembly and said aerating assembly; said pull rod assembly mounted in a passage for mounting said pull rod; and said casing portion including:

a lower cover body being punched into form by means of a sheet material to conform to lower portion of said faucet; a base portion furnished on said water-output end, and being in contact with a fixed base; a positioning ring furnished on water-output end for fastening said pull rod assembly; a connection edge furnished to be in close contact with an upper cover body, and inner side of said connection edge of said lower cover body furnished with a plurality of positioning flanges, of which outer edge to be in close contact with inner edge of said upper cover body;

said upper cover body being punched into form by means of a sheet material to conform to upper portion of said faucet; water-output end thereof furnished with a positioning ring for positioning said pull rod assembly in place; edge in contact with that of said lower cover body being furnished with a connection edge so as to engage with said connection edge and said positioning flanges of said lower cover body closely.

12. An improved structure for faucet comprising a casing portion, a single control rod, a threaded cap, a cold-hot water blending valve, an aerator assembly, a water-intake pipe assembly and a fastening assembly; said cold-hot water blending valve and a water pipe of said water-intake pipe assembly connected together as one piece; outer end of said water pipe connected with an aerator seat of said aerator assembly; a ring-shaped groove of said aerator seat mounted on a positioning ring of end of a lower cover body; said cold-hot water blending valve being fastened on a flat surface of said lower cover body by means of threads; said casing portion including:

said lower cover body being punched into a shape, with a sheet metal, in accordance with shape of lower part of said faucet; water-intake end thereof furnished with a flat surface for mounting said cold-hot water blending valve, and furnished with a round hole receiving a cold-hot water intake pipe; a positioning ring for said aerating assembly furnished on water-output end thereof; a connection edge with said upper cover body being provided, and inner side of said connection edge on said lower cover body furnished with a plurality of positioning flanges, of which outer surface to be engaged with inner surface of said upper cover body;

said upper cover body being punched into a shape in accordance with said faucet by using sheet metal; a positioning ring for fastening said aerating assembly furnished on water-output end thereof so as to engage with said connection line and said positioning flanges of said lower cover body; a cylinder body furnished in center of said upper cover body for mounting said cold-hot water blending valve, and upper outer surface of said cylinder body furnished with threads for mounting a threaded cap thereon.

* * * * *